United States Patent [19]

Holzboog

[11] Patent Number: 4,824,075

[45] Date of Patent: Apr. 25, 1989

[54] TILT ACTION DISPENSING VALVE ASSEMBLY

[76] Inventor: Walter Holzboog, 964 Claytonbrook Dr., Ballwin, Mo. 63011

[21] Appl. No.: 44,970

[22] Filed: May 1, 1987

Related U.S. Application Data

[63] Continuation of Ser. No. 580,118, Feb. 14, 1984, abandoned, which is a continuation of Ser. No. 284,478, Jul. 17, 1981, abandoned.

[51] Int. Cl.[4] ..... B65D 85/00

[52] U.S. Cl. ..... 251/349; 251/354; 222/402.22

[58] Field of Search ..... 251/349, 354, 339; 222/402.2, 402.22, 402.24

[56] References Cited

U.S. PATENT DOCUMENTS

| | | | |
|---|---|---|---|
| 2,704,172 | 3/1955 | Lapin | 251/349 |
| 3,048,307 | 8/1962 | Michel | 222/402.22 |
| 3,101,875 | 8/1963 | Michel | 222/402.22 |
| 3,176,889 | 4/1965 | Patapenko et al. | 222/402.2 |
| 3,450,316 | 6/1969 | Barker | 222/402.22 |

*Primary Examiner*—A. Michael Chambers

*Attorney, Agent, or Firm*—Gerald R. Hibnick

[57] ABSTRACT

For use in a tilt action valve for dispensing a pressurized viscous product, in which a grommet is held by a mounting cup and secures the valve stem and body, product leakage between the grommet and valve stem is minimized by forming in the grommet a pocket which fills with the dispensed product and then lies tightly against the valve stem. The pocket causes the valve and grommet to be tilted with easier control. The pocket's operation simplifies the construction of the grommet and valve body, thus permitting dimensions which enable cheaper parts costs and assembly.

3 Claims, 1 Drawing Sheet

TILT ACTION DISPENSING VALVE ASSEMBLY

BACKGROUND OF THE INVENTION

This application is a continuation of application Ser. No. 580,118, filed Feb. 14, 1984, now abandoned, which is a continuation of application Ser. No. 284,478, filed July 17, 1981, now abandoned.

This invention relates generally to tilt action valve assemblies for dispensing materials from pressurized containers. More specifically, this invention embodies a grommet specially designed to coact with the valve stem, valve seat and material to be dispensed to more tightly seal the periphery of the valve stem against leakage of the container contents, to operate more controllably with less tilt action pressure, and be easier and cheaper to assemble.

Tilt action valves, mounted on pressurized cans, for dispensing shaving cream, whipping cream, etc. are well known. A few examples are disclosed in U.S. Pat. Nos. 2,704,172; 2,852,168; and 2,877,936. Such valve assemblies are for dispensing materials which are mixed with gases under pressure. A common problem of prior art tilt valve assemblies is that the propellant gas itself and also the pressurized material leak out through the valve parts. The above cited patents teach construction which combat the leakage problem. Another prior art problem is that the valve stem and grommet are too resilient to be readily controllable by the tilting pressure applied by the forefinger of the typical user. If the valve assembly is not so resilient, then there typically results leakage around the valve stem. Efforts to resolve both of the above problems led to consideration of overly complex and expensive tilt valve assemblies, which were not practical from both manufacturing and sales aspects.

More recently, there has been commercialized a dispensing container in which the product to be dispensed and the gas propellant are kept separate at all times, and not mixed. The container includes a piston-like member which separates the gas from the product. In this manner, the product is not aerosolized or "whipped" and can be delivered as a viscous material, such as a spread cheese. Pressures of one hundred pounds per square inch are common for this type of dispenser. The use of prior art tilt action valves for such viscous material proved to renew the old problem of leakage between the valve stem and grommet. Designs to improve the sealing or gasketing action by the grommet against the valve stem, and also coactive designs of the stem, as by ribs, etc. to hold mating portions of the grommet, have provided some improvement, but resulted in a trade-off with other features and resulted in increased undesirable resiliency, design complexity, and production cost. Reference may be made to the following patents for examples of some of those designs: U.S. Pat. Nos. 2,889,086; 3,048,307; and 3,101,875.

The prior art has faced yet another problem, due to the need of specially configured valve stems and grommets. Such problem is parts assembly. The assembling of the valve stem, grommet and other portions of the tilt valve onto the mounting cup, for securing onto the top of the container, is not simple, as is evident from the herein cited references. The need to seat parts into precise mating relationship has prevented the simple assembling technique of sliding one part into the next.

SUMMARY OF THE INVENTION

The present invention seeks to provide a tilt action valve assembly, especially capable of dispensing viscous materials, without leakage between the valve stem and surrounding grommet. Between the inner, hollow, annular surface of the grommet, which fits tightly against the periphery of a relatively large longitudinal portion of the valve stem, and the lower, depending skirt portion of the grommet, which seals against the valve head when the valve is closed, there is formed in the grommet a relatively large, inverted pocket. This pocket is open to receive and retain a portion of the viscous product, when the valve stem is tilted, and thereafter to retain some of the viscous product after the valve stem returns to its normal position. One side wall of the inverted pocket extends along a significant length of the valve stem, commencing at or just above the valve head, such that the pocket-retained viscous material exerts force radially inward against the side wall to seal same tightly against the valve stem. The pocket also provides for more flexibility and tilt control than if the grommet were entirely solid between the valve stem and skirt. Various embodiments of the pocket formation and valve head are disclosed. All embodiments are economic to fabricate and easy to assemble. The simplicity of grommet and valve designs permits the grommet to be slipped into the mounting cup and then the valve stem is slipped up into the grommet.

DETAILED DESCRIPTION OF THE PREFERRED EMBODIMENTS

Figure 1:
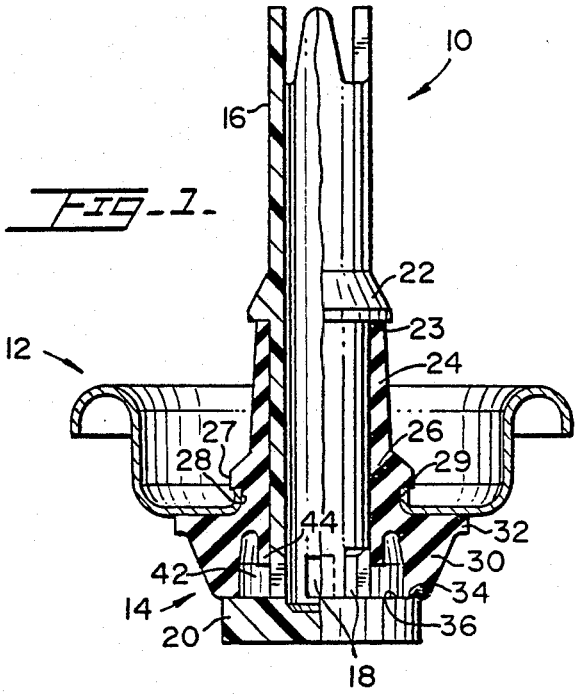
FIG. 1 is a view, partly in side elevation and partly in section, of a preferred embodiment of the valve assembly, with the valve closed.

In a tilt action dispensing valve assembly there are three basic elements: a tilt action valve, a sealing grommet, and a mounting cup. The prior art employs these just used and other identifying terms; however, their basic structure, coaction and relative means of final assembly to the top of a container are well known, see for example U.S. Pat. No. 2,704,172. For purposes of the following description, unless otherwise noted, the construction and coaction of the valve 10, the cup 12 and the grommet 14 in their various embodiments in FIGURES 1–7 can be conventional. Hence, only the primary differences over the prior art will be detailed hereinafter. It should be kept in mind that the primary goal of the invention is to provide a leak proof sealing between the grommet 14 and the valve 10, while at the same time enabling the valve to be tilted into the open position with smooth control of ingredient flow and relatively small force. Yet also, the design of the valve and grommet should be simple and inexpensive and enable easy assembling.

The tilt valve 10 is unitary, molded of stiff plastic, such as polystyrene, and has a hollow stem 16 which includes ports 18, three are sufficient, at its lower end, which end is closed by the valve seat 20. The top and bottom surfaces of the seat 20 can be smooth and parallel. Likewise, the exterior of the stem 16 can be smooth, except for a shoulder 22 or some structural element which will limit and position the upper end 23 of the grommet 14. The thus disclosed valve 10 is simpler in shape, easier to fabricate and less expensive than most of the prior art valves.

The patent FIGURES (as filed) are nearly three times the scale of a commercial embodiment in which: 40 millimeters is stem length; 6.25 mm is stem diameter; the stem bore is 4.0 mm; the ports are 2 mm wide and 3 mm high; the valve seat is 3 mm thick and 13 mm in diameter; and the shoulder has a 9.4 mm diameter and is 19 mm above the top of the valve seat.

The grommet 14 is to be of soft, flexible substance, such as rubber, and can be molded easily. Its upper portion 24 should be thin walled, such as 1 millimeter, to permit tilting the valve with a minimum of foreginger effort. The middle portion 26 of the grommet defines a detent having an 11.5 millimeter upper diameter 27 and a 10 millimeter lower diameter 28 which mates with the interior circular rim 29 of 10 millimeters of the mounting cup 12. The lower, skirt-like portion 30 of the grommet has horizontal facing upper ledge 32 which abuts the cup surface to provide sealing support therearound. The bottom, annular surface 34 sets against the upper face of the valve seat 20 for forming therewith the open-close mechanism of the tilt valve. The total length of the grommet is 19 millimeters.

Figure 2:
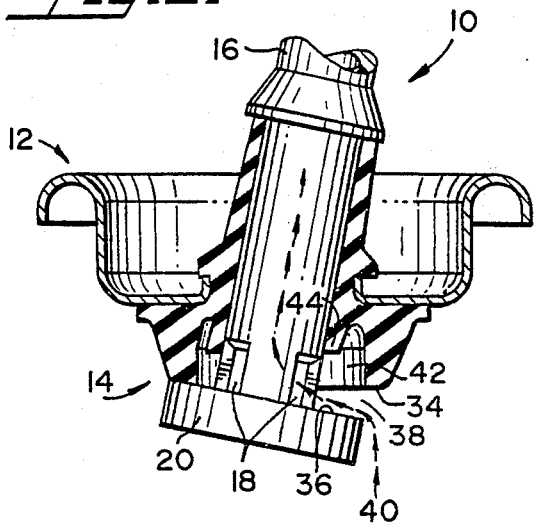
FIG. 2 is a sectional view of the valve of FIG. 1, shown in open, tilted position.
Figure 3:
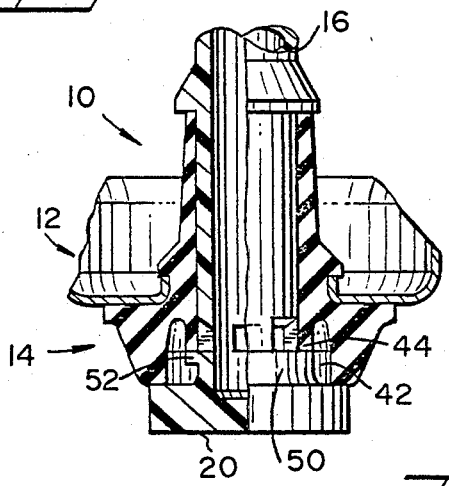
FIG. 3 is a view of a second embodiment in section and a third embodiment in side elevation, in valve closed position.
Figure 4:
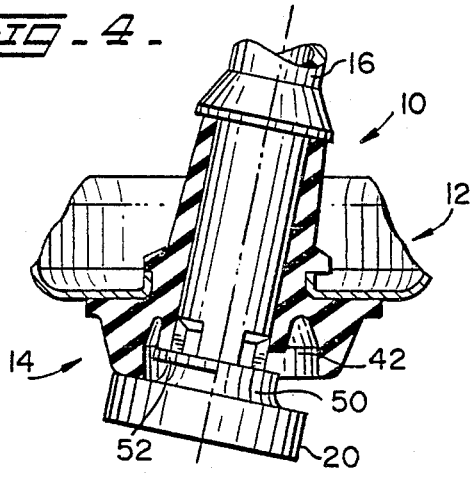
FIG. 4 shows the embodiments of FIG. 3 in section and in valve open position.

As shown in FIGS. 1 and 3, the valve stem is not tilted and thus the annular bottom surface 34 is tightly fitted against the top surface 36 of the valve seat 20. In FIGS. 2 and 4, the stem is tilted, thus forcing the surface 36 of the seat 20 away from the grommet surface 34 and defining an opening 38 through which can flow the viscous substance from the container (not shown) to which the mounting cup is secured. The short arrows 40 represent the substance flowing from the container, around the valve seat, through the opening 38, through the ports 18 and up through the hollow stem 16. The tilting force is typically of a few seconds duration and, upon its termination, permits the valve stem to be driven back to the closed position by the resiliency of the rubber grommet.

The thus far described grommet 14, in combination with the mounting cup 12 and the valve stem 10 form a unique assemblage, for use with a container having a pressurized, viscous substance. The uniqueness lies in the fact that: the valve stem 16 has a smooth, cylindric surface, interrupted only by the shoulder 22; the grommet has a thin smooth wall both interior and exterior from above the detent 26; and the diameter 27 of the detent 26, although larger than the diameter of the rim 29 of the cup 12, is small enough so that the hollow grommet 14 easily can be inserted upward through the mounting cup and seat the rim 29 in the lower detent diameter 28, in final position as shown in the figures. Thereupon, the valve stem is inserted from the direction of the bottom of the grommet, up therethrough, with the shoulder 22 making a tight, but sliding fit through the rim 29, until the valve seat upper surface 36 abuts the lower annular surface 34 of the grommet skirt 30.

Figure 7:
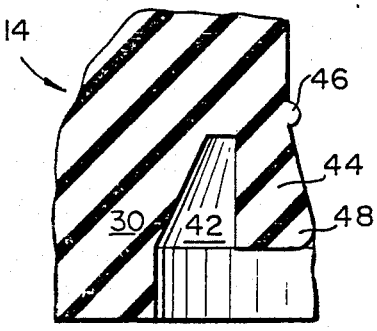
FIG. 7 illustrates in section another embodiment of the grommet of the invention.

Although the just described configuration and combination of the grommet, mounting cup, and valve stem is an important advance in the art, the next to be described configuration of the grommet 14 and its coaction with adjacent portions of the valve stem and seat more greatly distinguishes this invention over the prior art and provides a superior tilt action valve assembly. Several of the figures show different embodiments. Reference first will be to FIGS. 1, 2 and 7. Formed in the grommet 14, in its lower, skirt-like portion 30, is an inverted pocket portion 42 which is annular in form. The opening or mouth of the pocket is at the bottom skirt surface 34, which abuts the top surface 36 of the valve seat 20 and is sealed thereby when the valve stem is in its normally non-tilt position, as shown in FIG. 1. The inner side wall 44 of the pocket is shorter (except in FIG. 5) than the outer wall and opens to the ports 18.

In operation, in all of the embodiments of FIGS. 1 through 7, when the valve stem is tilted into dispensing orientation, as in FIGURES 2 and 4, and the viscous product flows through the opening 38, into the ports 18 and out from the top of the stem 16, there will be forced into the inverted pocket 42 a quantity of the viscous product, and some will remain in the pocket after the tilt action is terminated and the valve returns to normal non-tilt position and the pocket is sealed. The thus trapped viscous product will exert a radial force in the pocket and force its side wall 44 against the adjacent lower portion of the stem 16 and hold these two parts tightly against one another to prevent any seepage of the viscous product therebetween, as is a common problem in prior art tilt valves not having the inverted pocket 42.

It is necessary to maximize the volume of the pocket 42 and the length of its side wall 44, while not unduly weakening the grommet. By virtue of the pocket, the grommet is not solid in its skirt. Thus the grommet is "softer", i.e., is more easily tilted—a decided advantage over the "stiff" grommets in the prior art. By being softer to the control touch, the grommet of the present invention is easier to use, not as subject to spurting of excess product, wasted product, etc.

Although it would be simpler to mold the grommet so that the side wall 44 is planar, the great tendency for the pressurized product to work its way up between the grommet and the stem causes the simple pocket 42, in some instances, not to be a perfect solution to the problem. Hence, with reference to greatly enlarged FIG. 7, one or both added features of a ring 46 and a widened lip 48 can enhance the sealing operation of the pocket wall 44 against the stem 16.

Figure 5:
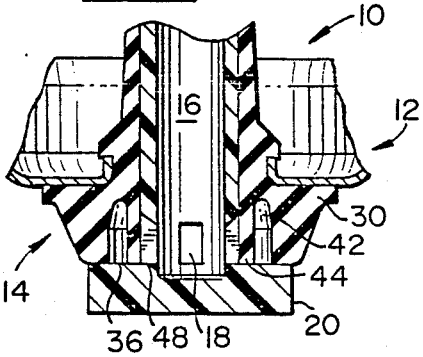
FIGS. 5 and 6 illustrate three embodiments.

Since the problem of seepage of the viscous product between the grommet and valve stem occurs also when the stem is not tilted, the pocket 42 further can be sealed, as shown in FIGS. 3–5. In FIGURES 3 and 4, the valve seat 20 has a raised central portion 50, which abuts the bottom or lip of the side wall 44. The difference between the embodiments of the left and right sides of FIGS. 3 and 4 is that, in the right side, the raised portion 50 is a simple plateau, which also reduces the effective volume of the pocket 42; whereas, the left embodiment of FIGS. 3 and 4 uses an overhang 52 to underlie the wall 44 and not reduce the volume of the pocket as much.

In FIG. 5, there is illustrated the configuration of the grommet side wall 44 which extends its lip 48 (either as in FIG. 1 or 7) all the distance to the top surface 36 of the valve seat 20, for sealing the pocket portion. This configuration not only seals against the valve seat, but maximizes the length of the side wall 44 to better the tight fit thereof against the valve stem. However, by this configuration, the tilt-obtained entry space form the opening 38 into the ports 18 is reduced.

Figure 6:
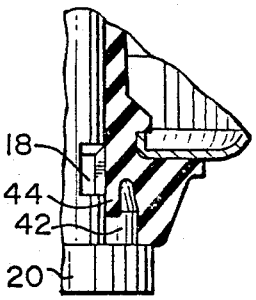

Another aspect of the seepage problem is seepage of the product into the ports 18 when the valve is in the closed position. FIG. 6 shows a solution to reduce such seepage. By elevating the ports 18 so that the side wall 44 covers them, the radial force on the side wall will seal the ports, except in the tilted dispensing position. It will be appreciated that the thus elevated ports will not be uncovered as much during dispensing as in the embodiment of FIG. 1; thus requiring more tilt to achieve as much product dispensing.

In each of the embodiments of FIGS. 3–7, the first discussed unique and advantageous relationship of grommet, mounting cup and valve also combine to enhance the ease of assembly and reduce cost of manufacture.

The variations between the embodiments are not mutually exclusive and can, for the most part, be combined in several subsets to minimize the problem of product seepage between the grommet and valve stem, and also into the valve stem.

Hereinabove and in the figures, there have been described and illustrated preferred and modified forms of the invention. It will be apparent to those skilled in the art that some changes in features and design can be made without departing from the scope of the invention, which scope is set forth and defined by the appended claims.

I claim:

1. For use in a tilt action valve assembly in which a valve body has a valve seat and a hollow stem with port means communicating between the interior of the stem and the top of the valve seat for passage therethrough of a viscous product under pressure; said valve body being secured to a mounting means by a sealing grommet which surrounds at least a lower portion of the valve stem, including the port means, and abuts the top of the valve seat; tilting of the valve stem relative to the mounting means causing the valve seat to move away from a lower portion of the sealing grommet and opening access to the port means for product located below the valve seat; the improvement which comprises means for inhibiting the seepage of the product between the valve stem and the sealing grommet, said inhibiting means comprising a pocket formed in the lower portion of the grommet, said pocket configured and positioned for receiving some of the viscous product as it flows toward the port means and retaining such product even after valve stem tilting is terminated; said pocket having a side wall lying along a significant length of the lower portion of the valve stem, so as to abut the top of the valve seat, such that pocket retained product exerts a significant force against said side wall to urge it against the lower portion of the valve stem to thereby inhibit product seepage therebetween.

2. For use in a tilt action valve assembly in which a valve body has a valve seat and a hollow stem with port means communicating between the interior of the stem and the top of the valve seat for passage therethrough of a viscous product under pressure; said valve body being secured to a mounting means by a sealing grommet which surrounds at least a lower portion of the valve stem, including the port means, and abuts the top of the valve seat; tilting of the valve stem relative to the mounting means causing the valve seat to move away from a lower portion of the sealing grommet and opening access to the port means for product located below the valve seat; the improvement which comprises means for inhibiting the seepage of the product between the valve stem and the sealing grommet, said inhibiting means comprising a pocket formed in the lower portion of the grommet, said pocket configured and positioned for receiving some of the viscous product as it flows toward the port means and retaining such product even after valve stem tilting is terminated; said pocket having a side wall lying along a significant length of the lower portion of the valve stem, such that pocket retained product exerts a significant force against said side wall to urge it against the lower portion of the valve stem to thereby inhibit product seepage therebetween; and the length of said side wall, in combination with the position of the port means, causes said side wall to cover the port means when the valve stem is not being tilted.

3. For use in a tilt action valve assembly in which a valve body has a valve seat and a hollow stem with port means communicating between the interior of the stem and the top of the valve seat for passage therethrough of a viscous product under pressure; said valve body being secured to a mounting means by a sealing grommet which surrounds at least a lower portion of the valve stem, including the port means, and abuts the top of the valve seat; tilting of the valve stem relative to the mounting means causing the valve seat to move away from a lower portion of the sealing grommet and opening access to the port means for product located below the valve seat; the improvement which comprises means for inhibiting the seepage of the product between the valve stem and the sealing grommet, said inhibiting means comprising a pocket formed in the lower portion of the grommet, said pocket configured and positioned for receiving some of the viscous product as it flows toward the port means and retaining such product even after valve stem tilting is terminated; said pocket having a side wall lying along a significant length of the lower portion of the valve stem, such that pocket retained product exerts a significant force against said side wall to urge it against the lower portion of the valve stem to thereby inhibit product seepage therebetween; and said pocket has another side wall the end of which abuts the valve seat at an elevation different than the end of said side wall, and the valve seat has an interior portion which extends into abutting position with the end of said side wall.

* * * * *